United States Patent [19]

Ayer

[11] 4,308,605

[45] Dec. 29, 1981

[54] BALANCE WHEEL ASSEMBLY

[76] Inventor: Henry E. Ayer, Rte. #1, Box 180, Green City, Mo. 63545

[21] Appl. No.: 120,620

[22] Filed: Feb. 12, 1980

[51] Int. Cl.[3] ..... G04B 15/00; G04B 29/00

[52] U.S. Cl. ..... 368/127; 368/325

[58] Field of Search ..... 368/124–130, 368/139, 140, 168, 169, 324–326; 308/10

[56] References Cited

U.S. PATENT DOCUMENTS 1,981,110 11/1934 Kochendarfer ..... 368/127

2,593,671 1/1946 Wolfe ..... 368/127

2,724,235 11/1955 Bauerle ..... 368/224

3,845,997 11/1974 Boden et al. ..... 308/10

3,954,310 5/1976 Rava ..... 308/10

*Primary Examiner*—Vit W. Miska

[57] ABSTRACT

A balance wheel assembly for clock works, and the like, the assembly including a base plate, lower and upper pivot blocks mounted on the base plate, the pivot blocks having opposed conical recesses therein, a vertical shaft pointed at either end disposed in the recesses, a balance wheel fixed to the shaft, and a magnet proximate the upper pivot block and operative to urge the shaft toward the upper pivot block against gravitational pull.

6 Claims, 3 Drawing Figures

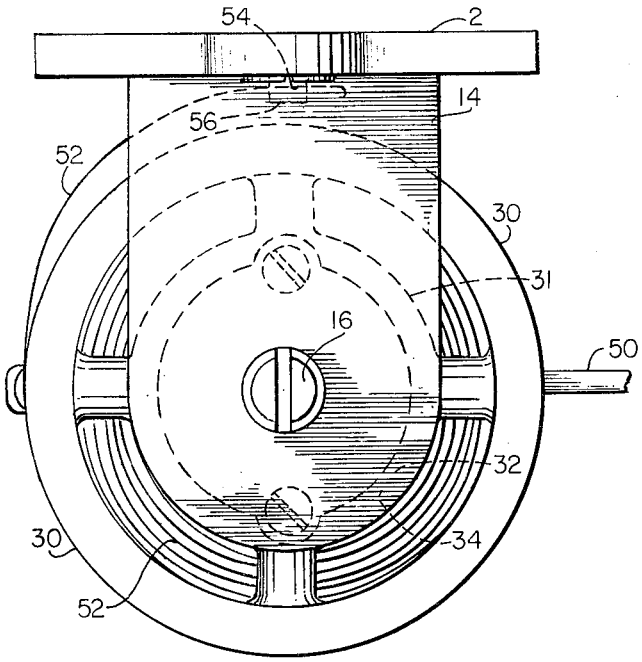
Fig. 2
Fig. 3
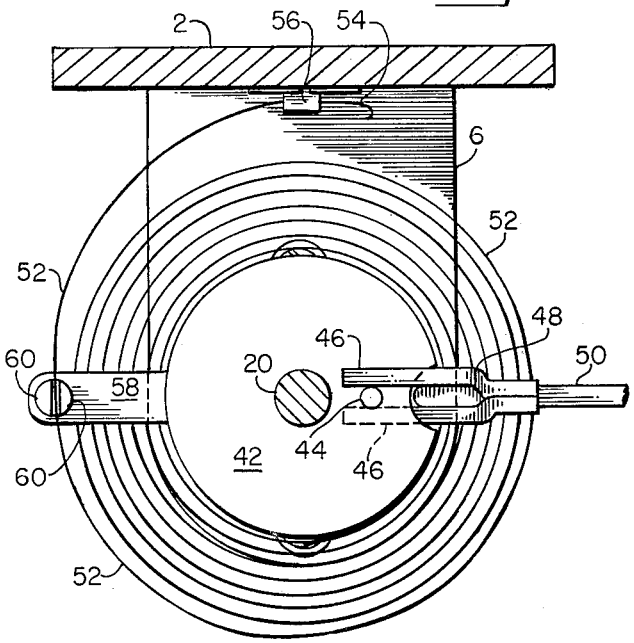

BALANCE WHEEL ASSEMBLY

BACKGROUND OF THE INVENTION

1. Field of the Invention

This invention relates to a balance wheel assembly and is directed more particularly to the mounting of vertical balance wheel shafts for clock works, and the like.

2. Description of the Prior Art

It is known to provide in clock-works and the like, a balance wheel assembly, the balance wheel being mounted on a vertical shaft, the shaft having a pointed, or conical, configuration at either end thereof, the shaft being mounted in upper and lower pivot blocks. The blocks are provided with opposed conical recesses for receiving the pointed ends of the shaft. In operation, the shaft rotates in the pivot blocks. Because of gravity, the wear on the lower pivot block is substantially greater than the wear on the upper pivot block, causing undue enlargement of the recess in the lower pivot block, with consequent displacement of the shaft from true vertical, and/or "wobbling" of the shaft.

SUMMARY OF THE INVENTION

An object of the present invention is to provide a balance wheel assembly having means for equalizing the wear on the pivot blocks, thereby preserving for a longer period the functional integrity of the assembly.

With the above and other objects in view, as will hereinafter appear, a feature of the present invention is the provision of a balance wheel assembly including a base plate, lower and upper pivot blocks mounted on the base plate, the pivot blocks having opposed conical recesses therein, a vertical shaft pointed at either end disposed in the recesses, a balance wheel fixed to the shaft, and magnet means proximate the upper pivot block and operative to urge the shaft toward the upper pivot block against gravitational pull.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings:

FIG. 2 is a top plan view thereof; and

FIG. 3 is a sectional view taken along line III—III of FIG.1.

DESCRIPTION OF THE PREFERRED EMBODIMENT

Figure 1:
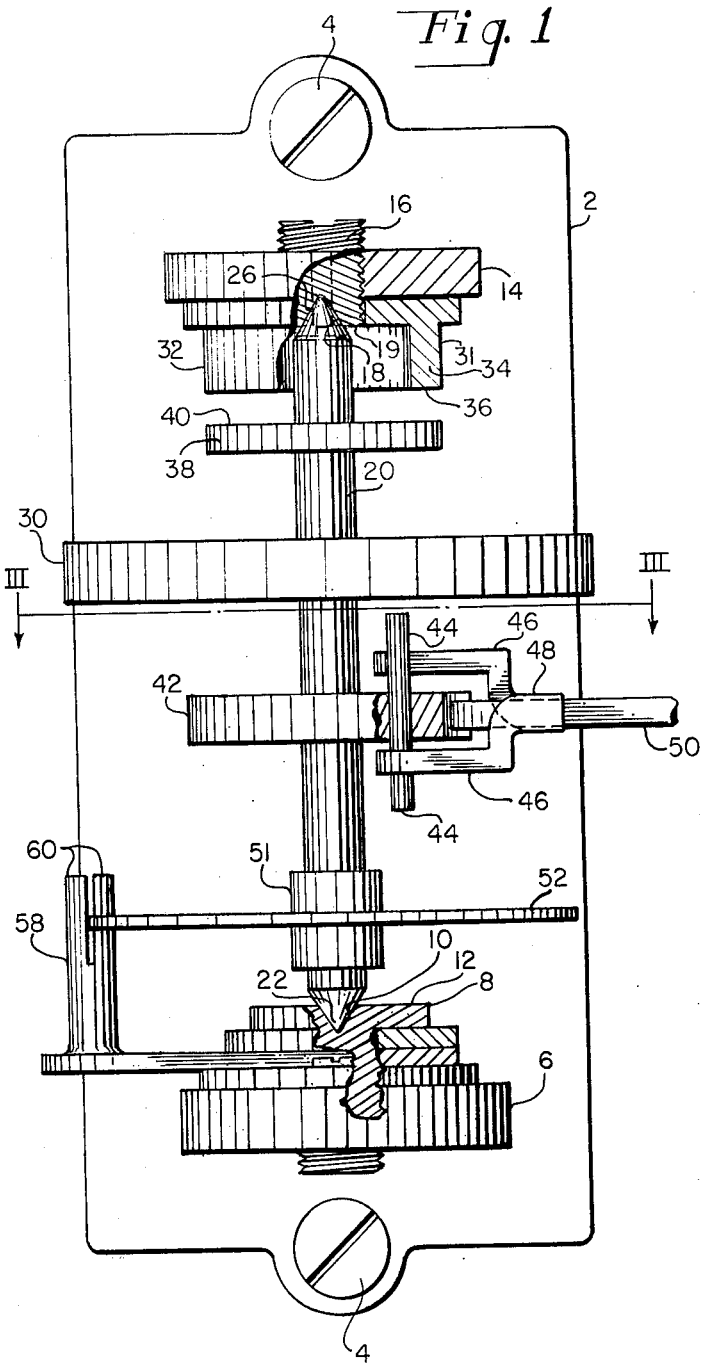
FIG. 1 is an elevational view of one form of balance wheel assembly illustrative of an embodiment of the invention.

Referring to the drawings, it will be seen that the assembly includes a base plate 2 adapted to receive screws 4 for attachment of the base plate to a vertical member (not shown). A lower frame member 6 extends from the base plate 2 and supports a lower pivot block 8 having a generally conically-shaped recess 10 in an upper surface 12 thereof.

In like manner, an upper frame member 14 extends from the base plate 2 and has fixed thereto an upper pivot block 16 having a generally conically-shaped recess 18 in a lower surface 19 thereof. The recesses 10, 18 are in vertical alignment and are opposed to each other.

An elongated shaft, or balance staff, 20 has a first point 22 at a first end 24 thereof and a second point 26 at a second end 28 thereof, the first point 22 being disposed in the first recess 10 and the second point 26 being disposed in the second recess 18. The shaft 20 is thus adapted to rotate between the pivot blocks 8, 16 with minimal frictional contact therebetween.

The assembly further includes a balance wheel 30 fixed to the shaft 20 for the purpose of augmenting and regulating the motive force of the assembly, as will be described below.

Attached to the upper frame member 14 is a magnet means 31 comprising a magnet 32 in the shape of an inverted cup, having an annular wall 34 disposed concentrically of the shaft second end 28, the wall 34 having a downwardly-extending free edge 36.

Fixed to the shaft 20, between the balance wheel 30 and the magnet 32 is a metal roller 38, which is a round, planar member magnetically attracted to the magnet 32. A flat upper surface 40 of the roller 38 is spaced from, but proximate the free edge 36 of the magnet 32. The diameter of the roller 38 is at least equal to the diameter of the wall 34, so that the free edge 36 of the magnet and peripheral portions of the roller 38 are in close proximity and magnetically attracted to each other.

Also mounted on the shaft 20 is an escapement roller 42, having a pin 44 extending therethrough, the pin being engageable by arms 46 of a fork 48 fixed to a pallet 50, which in turn is operated by an escapement wheel (not shown). Below the escapement roller 42, there is fixed to the shaft 20 a collar 51 to which is attached an end of a hairspring 52, which is also fixed at the other end 54 thereof to the base plate 2, as by a bracket 56. A regulating lever 58 is pivotally mounted on the lower frame member 6 and has upstanding arms 60 which engage either side of the hairspring 52.

In operation, force is transmitted to the escapement wheel which is held in place by the pallet 50. The force of the wheel seeking a turning motion causes movement of the pallet 50 and therefore the fork 48, which nudges the escapement roller 42 in a turning direction, for example, in a counter-clockwise direction. When the escapement roller 42 turns, so does the balance wheel 30. The balance wheel, being of greater mass than the roller 42 tends, once it starts moving, to continue turning, taking the shaft 20 in a turning motion with it. However, in due course the turning of the shaft 20 causes tightening of the hairspring 52 to a point at which the force of the spring on the shaft 20 overcomes the inertia of the balance wheel, thereby stopping the counter-clockwise rotation of the shaft 20 and starting a reverse motion in the clockwise direction. The shaft turns clockwise until the pin 44 engages the fork 48, causing movement of the pallet 50, which in turn permits another increment of movement of the escapement wheel. Each complete cycle of operation of the escapement roller is referred to as a "beat". Usually, such an assembly is constructed to afford from sixty to three-hundred sixty beats per minute.

If it is desired to alter the force of the hairspring 52, such is accomplished by pivoting the regulating lever 58 to a position in which, by virtue of the arms 60 contacting the hairspring 52, the effective length of the hairspring is altered. The operation as described is well known in the art.

Thus,, the shaft 20 is continuously moving one direction and then the other. The continuous operation of the shaft 20 and the natural force of gravity could cause rapid deterioration of the precision of the recess 10 in the lower pivot block 8, as well as the first point 22 of the shaft 20. However, the magnet 32, and particularly the free edges 36 thereof, attract the roller 38 upwardly, to counteract the pull of gravity and provide for even wear of the recesses 10 and 18, and the points 22, 26.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A balance wheel assembly comprising a base plate, a lower pivot block attached to said base plate and having a first conical recess in a top surface thereof, an upper pivot block attached to said base plate and having a second conical recess in a bottom surface thereof, said first and second recesses being in vertical alignment and opposed to each other, an elongated shaft having a first point at a first end thereof and a second point at a second end thereof, said first point being disposed in said first recess and said second point being disposed in said second recess, a balance wheel fixed to said shaft, and magnet means disposed proximate said upper pivot block and operative to urge said shaft toward said upper pivot block against gravitational pull.

2. The invention in accordance with claim 1 including a metal roller fixed to said shaft and disposed between said balance wheel and said second point and being magnetically attracted to said magnet means.

3. The invention in accordance with claim 2 including a lower frame member extending from said base plate, and an upper frame member extending from said base plate, said lower pivot block being attached to said lower frame member and said upper pivot block being attached to said upper frame member.

4. The invention in accordance with claim 3 in which said magnet means comprises an annular member disposed concentrically about said shaft proximate said second end of said shaft.

5. The invention in accordance with claim 4 in which said annular member has a free edge spaced from and proximate said metal roller.

6. The invention in accordance with claim 5 in which the diameter of said metal roller is at least equal to the diameter of said annular member.

* * * * *